US005462352A

United States Patent [19]

Mette

[11] Patent Number: 5,462,352

[45] Date of Patent: Oct. 31, 1995

[54] APPARATUS AND METHOD FOR HOMOGENEOUS MIXING OF FLUID COMPONENTS TO FORM A MIXED PRODUCT HAVING A MORE ACCURATELY SET MIXTURE RATIO

[76] Inventor: Manfred Mette, Ringstrasse 19a, 2000 Hamburg 73, Germany

[21] Appl. No.: 142,312

[22] PCT Filed: May 16, 1992

[86] PCT No.: PCT/EP92/01082

§ 371 Date: Nov. 16, 1993

§ 102(e) Date: Nov. 16, 1993

[87] PCT Pub. No.: WO92/20439

PCT Pub. Date: Nov. 26, 1992

[30] Foreign Application Priority Data

| | | | |
|---|---|---|---|
| May 16, 1991 | [DE] | Germany | 41 16 031.2 |
| Sep. 10, 1991 | [DE] | Germany | 41 30 413.6 |
| Dec. 17, 1991 | [DE] | Germany | 9115831 U |

[51] Int. Cl.[6] ..... B01F 15/02; B01F 15/04

[52] U.S. Cl. ..... 366/131; 366/160.2

[58] Field of Search ..... 366/131, 134, 366/136, 137, 150, 152, 160, 161, 162, 163; 137/262, 264, 265

[56] References Cited

U.S. PATENT DOCUMENTS

| | | | |
|---|---|---|---|
| 3,830,473 | 8/1974 | Liferman | 366/136 |
| 4,872,763 | 10/1989 | Higuchi | 366/160 |
| 4,952,066 | 8/1990 | Hoffland | 366/160 |
| 5,046,856 | 9/1991 | McIntire | 366/137 |

FOREIGN PATENT DOCUMENTS

| | | |
|---|---|---|
| 3132706 | 3/1983 | Germany . |
| 1392954 | 5/1975 | United Kingdom . |

*Primary Examiner*—Robert W. Jenkins
*Attorney, Agent, or Firm*—Michael J. Striker

[57] ABSTRACT

The apparatus for homogeneous mixing of fluid components includes a feed tank (B1) for a liquid component having an overflow weir dividing the feed tank (B1) into a first chamber and a second chamber; another feed tank (B2) for another fluid component; a mixing pipe (MR) for mixing the fluid components; a pump (P3) having a regulated drive motor connected to the second chamber of the feed tank (B1) to feed the liquid component to the mixing pipe (MR); another pump (P1) connected to the other feed tank (B2) to feed the other fluid component to the mixing pipe (MR); a collecting tank (B3) having an overflow weir to maintain a uniform counter-pressure at the mixing pipe (MR) and being connected to the mixing pipe (MR) to receive the mixed product formed from the liquid component and the other fluid component; and additional pump (P2) for circulating the liquid component from the second chamber of the feed tank (B1) to the first chamber of the feed tank (B1) to maintain a level of the liquid component in the first chamber at a constant level below a constant level of the liquid component in the second chamber to provide a constant pressure difference across the pump (P1).

26 Claims, 4 Drawing Sheets

APPARATUS AND METHOD FOR HOMOGENEOUS MIXING OF FLUID COMPONENTS TO FORM A MIXED PRODUCT HAVING A MORE ACCURATELY SET MIXTURE RATIO

BACKGROUND OF THE INVENTION

The invention relates to an apparatus for mixing and/or homogenizing fluid components with feed lines for the various components and at least one outlet line for the mixed product and to a process for the continuous mixing of fluid components to form a mixed product with adjustable mixture ratio. The fluid components can be liquid and/or gaseous components.

An apparatus for proportioning and mixing beverages from several components is known from DE 31 32 706 Al.

A disadvantage of the known apparatus consists in that the mixture ratio in the end product can fluctuate in spite of correct proportioning. To prevent such fluctuations to a great extent an after-mixing tank is provided downstream in the known apparatus in addition so that the mixing is achieved in at least three stages.

Moreover, it is known from Patent Application P 41 16 031, not yet published, to use tanks with an overflow weir within the framework of the mixing installations.

SUMMARY OF THE INVENTION

The object of the invention is to provide an apparatus and a process enabling accurate proportioning and improved mixing to form a homogeneous end product with reduced expenditure on the apparatus.

The apparatus according to the invention is provided with a feed tank having an overflow weir for maintaining a predetermined constant liquid level of the liquid component in at least one feed line. Accordingly, pressure fluctuations in the feed lines can not influence the supplied volumetric flow of the component.

As a result of an orifice-containing member provided between the feed tank and the outlet line, only a constant volumetric flow can flow out of the feed tank due to the uniform upstream pressure so that the ratio of the supplied components is fixed by physical marginal conditions given an appropriate choice of orifice size. Accordingly, costly measuring and regulating systems in the feed lines for influencing the supplied volumetric flow can be advantageously dispensed with. The installation accordingly operates reliably and with low maintenance. This is particularly true when the output components exit freely under atmospheric pressure.

If necessary, a mixing pipe may be provided between the feed tank and outlet line to improve the mixing of the components.

When a collecting tank for the mixed product having an overflow weir for maintaining a uniform counter-pressure is provided between the feed tank and outlet line, there is a constant pressure difference between the supplied components and the pressure in the outlet line. This step also serves to eliminate disturbances in the installation caused by the existing pipeline network. Since the marginal conditions for the mixing process accordingly remain constant, the mixture ratio and the volume throughput are also correspondingly uniform.

In the case of certain liquids it is advantageous to arrange pumps between the feed tank and collecting tank, which pumps advantageously have regulated drive motors. As a result of the constant marginal conditions, costly proportioning pumps can be dispensed with. It is sometimes sufficient to use displacement pumps, e.g. gear pumps. In certain cases, investment costs for the installation can be further reduced by using flow pumps, e.g. impeller pumps, instead of displacement pumps. The mixture ratio can be changed at will by regulating the speed of the drive motors.

Outfitting the tanks with pressure compensation openings which are preferably connected with one another by lines likewise serves to maintain constant external operating conditions. Even when the tank contents change, the pressure of the liquid remains constant, since atmospheric pressure always prevails in the tank due to the pressure compensation openings. The pressure compensation openings are connected by lines when operating, for example, under an inert gas atmosphere or a higher pressure, particularly with gaseous liquids.

The differential pressure between the supplied components and the output mixed product remains constant when a pump with pipelines which circulates the tank contents is associated with the feed tank and/or collecting tank. This also makes it possible to empty the tank when turning off the installation.

The proportioning accuracy in particular when mixing a plurality of components in sharply diverging proportions can be improved when quantities are first mixed together in equal proportions and the outlet line is then switched as a feed line of another mixing and proportioning installation.

The proportions can be regulated and adjusted in a very sensitive manner when at least one overflow weir is constructed so as to be adjustable, particularly regulated, with respect to height or level.

The consistency of the mixture ratio can be further increased by providing a measuring length for determining the mixture ratio with signal lines leading to a regulator in a working connection with the drive motor, with at least one pump and/or at least one weir.

By providing the tank with a filling level sensor in a working connection with an actuating device in the feed line, the tank can be prevented from overflowing during operation and can be emptied automatically when the installation is switched off by controlling the circulating pump of the tank.

Further advantageous developments of the installation are described in the claims appended hereinbelow.

The object of the process is met in that a portion of at least one component overflows a weir prior to mixing.

BRIEF DESCRIPTION OF THE DRAWING

Further advantages, details and features essential to the invention are indicated in the following description of two preferred embodiment forms of the invention with reference to the accompanying drawings.

DESCRIPTION OF THE PREFERRED EMBODIMENTS

Figure 1:
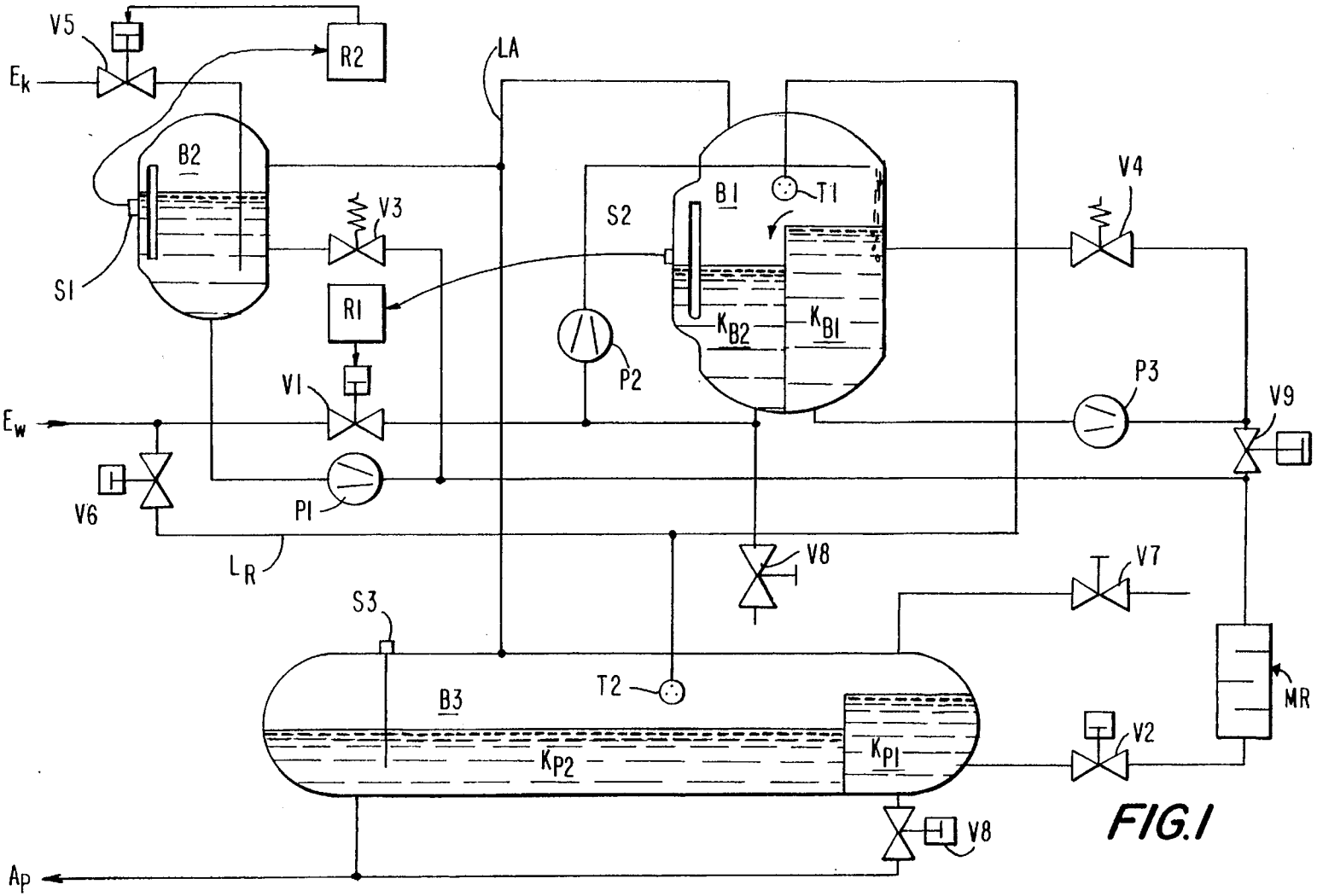
FIG. 1 is a schematic view of a mixing apparatus for two components.

A first embodiment of the apparatus according to the invention shown in FIG. 1 can be used for mixing at least two liquid media of different densities and viscosities for homogenizing the mixture to form a finished product. In its basic construction, it includes the feed tanks B1, B2 for the product components and a collecting tank B3 as a buffer tank and storage for the finished product.

The liquid of higher density, usually a concentrate, is supplied to the installation at the input $E_k$ to the tank B2. The lighter component, generally water, is supplied at the input $E_w$ to the tank B1. The finished product emerges from the system at the output $A_p$. The collecting tank and feed tank are linked via a pipeline network with valves V which can be controlled in part by a program so as to switch automatically. Monitoring sensors monitor individual process steps of the process flow.

As shown in more detail in FIG. 1 displacement pump P1 for delivering concentrate and P3 for delivering water serves to convey liquid within the installations. The lighter product component in the supply tank B1 is circulated by an impeller pump P2. The two components are mixed in a mixing pipe MR into which the pressure lines of the pumps P1 and P3 open. The mixture exits the mixing pipe MR through a line opening into the collecting tank B3.

The proportioning accuracy of the displacement pumps P1 and P3 depends on a constant pressure difference between the suction side and the delivery or pressure side of the pumps at constant speed during the mixing process. The two-component mixing apparatus shown in the drawing allows for delivery according to constant pressure differences at the pumps P1, P3 used for proportioning and via the mixing pipe MR. The gas spaces of the tanks B1, B2, B3 are connected together or alternately with the environment. Occurring pressure fluctuations can accordingly be compensated at any time. The compensation lines are designated by $L_A$.

Further, the liquid sucked out of the tank B1 maintains a constant feed level relative to the pump P3. It is not dependent on the amount of liquid flowing into the tank B1. This is achieved by an overflow system having a liquid space in the tank B1 which is divided in two with chambers $K_{B1}$, $K_{B2}$ and permanent circulation of the liquid by pump $P_2$. The quantity flowing out of $K_{B1}$ to the displacement pump $P_3$ is replaced via the feed line $E_w$ with valve V1. The signal of the filling level sensor S2 is fed to the regulator R1 which in this case can be a simple switch. The regulator R1 opens the valve V1 as a function of the respective filling level. The level of liquid in chamber $K_{B2}$ is thus maintained between a minimum and maximum below the overflow. The pump P2 delivers more liquid from chamber $K_{B2}$ into chamber $K_{B1}$ than is removed from the latter during the mixing process. The surplus flows over an overflow edge back into chamber $K_{B2}$. The pump P2 runs continuously when the apparatus is operating without disruptions and ensures that the liquid in chamber $K_{B1}$ is always at the overflow edge.

The principle of level regulation by the overflow system is also realized in the buffer or collection tank B3 by dividing the latter into chambers $K_{p1}$ and $K_{p2}$. This ensures that no fluctuations occur in the differential pressure as a result of the operation of the apparatus at the output of the mixing pipe or on the pressure side of the displacement pumps P1 and P2, i.e. on the mixture side. A circulating pump is dispensed with in this case, since the finished product is removed from $K_{p2}$ for further use.

The pressure on the upstream side of the displacement pump P1 is likewise kept constant. In principle, a tank with an overflow edge is also suitable in this case for maintaining a constant upstream pressure. However, in the example shown in the drawing, the quantity flowing from input $E_k$ into the tank B2 is regulated in that the supplied quantity is regulated via the filling level sensor S1 by an interposed regulator R2 via the feed valve V5 in such a way that the liquid level in the tank B2 remains constant.

The interconnected tanks and the constant level of the liquids in the chambers $K_{B1}$ and $K_{B2}$ ensure constant system parameters at the proportioning system given stationary production and constant removal of product. However, for practical apparatus operation with inevitable disruptions in the production process, additional starting and stopping processes must be taken into account. To eliminate their influence on the proportioning accuracy to a great extent, the apparatus preferably also works by batch operation during continuous removal of product with respect to proportioning and mixing. In so doing, every mixing process spans a certain period of time, generally 20 seconds, for example, and cannot be interrupted. It is initiated by opening the valve V2 during continuous operation of the pump P1 and is concluded by closing V2 after the mixing period expires. After a pause, e.g. approximately 10 seconds, the next batch can be started. However, this batch is released only when the level of the finished product in the buffer tank B3 has sunk to the extent that its storage volume is sufficient to receive a full batch. In the mixing phase, the valve V3, a safety valve, is closed by spring force. During the intervals between batches, it opens due to the increasing line pressure. The pump P1 then circulates.

This applies in an analogous manner for the pump P3 and pressure-relief valve V4. Valve V9 simultaneously closes the valve V2 and cuts off the lines as long as the pumps P1 and P2 circulate when valves V3 and V4 are open.

The advantage of batch operation consists in that the same quantities are always proportioned and mixed without being influenced by disruptions in the production process of a production line. A discontinuous product removal at the output $A_p$ has no effect on the proportioning accuracy.

Tank cleaning heads T1, T2 which are connected to the upstream water flow via line $L_R$ and V6 are arranged inside the tanks B1 and B3. Valve V7 serves to aerate the tank volumes. The valves V8 enable the tank contents to drain. The circulating pump P2 makes it possible to empty the tank B1 completely via the displacement pump P3 after closing valve V1.

In batch operation, the tanks B1, B2 are first filled until the filling level sensors S1, S2 signal the pre-adjusted desired filling level. The feed valves V1 and V5 are then closed. The pumps P1, P2, P3 can already be started at alternate times while filling. After closing the feed valves V5 and V1, valve V2 is opened so that the pumps P1 and P3 deliver constant a volumetric flow from the tanks to the mixing pipe MR.

For continuous operation of the apparatus it is advisable, instead of a sequential control, to switch or lock on the signal of the filling level sensors S1 and S2 to regulators which supplement the quantities removed by P1 and P3 via valves V1, V2 constructed as regulating valves.

Figure 2:
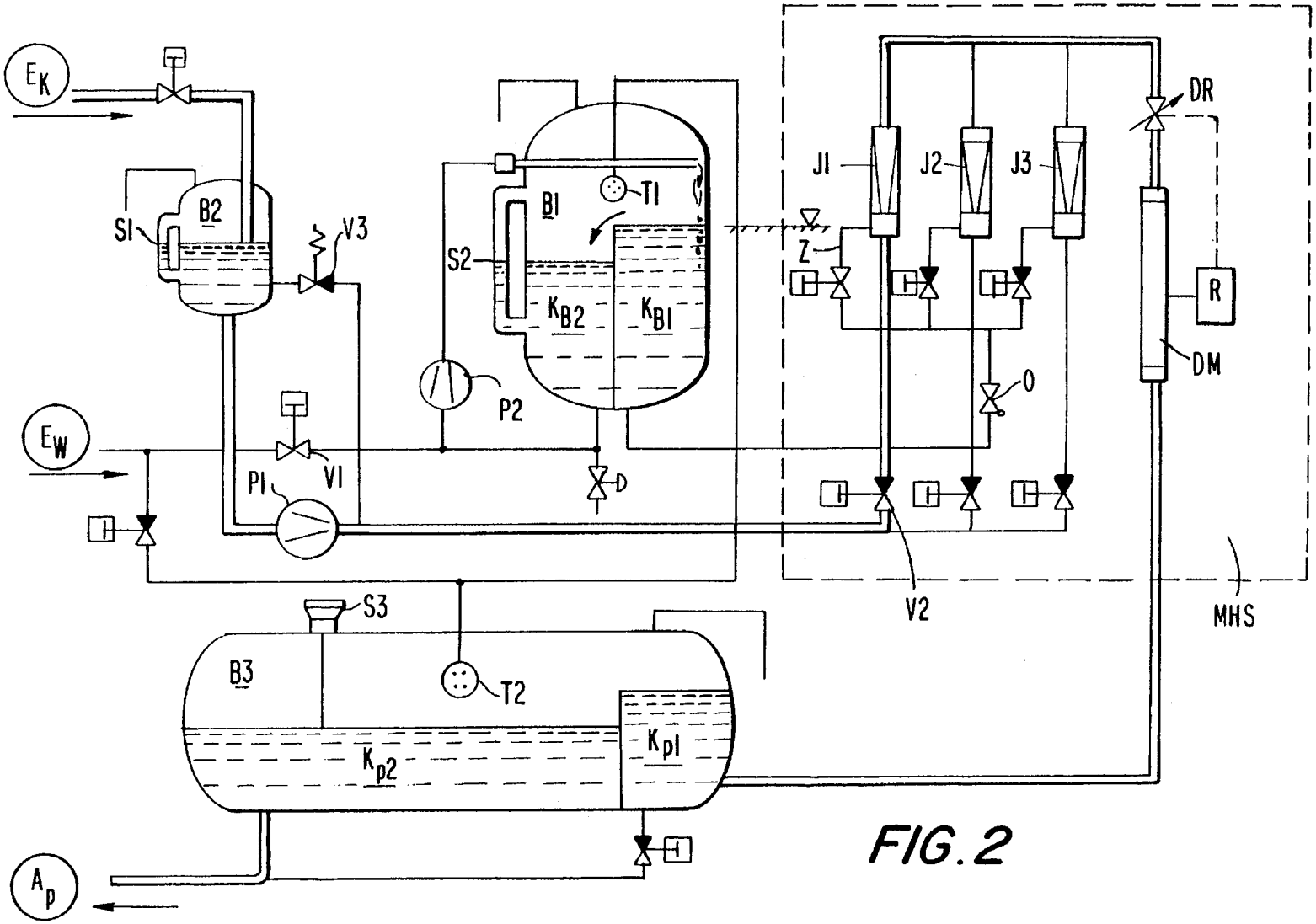
FIG. 2 shows a simple apparatus for mixing and homogenizing liquid and/or gaseous components to form a product with adjustable mixture ratios.

Another embodiment of the apparatus according to the invention shown in FIG. 2 can be used for mixing at least two liquid media of different densities and viscosities and for homogenizing the mixture to form a finished product. In its basic construction it includes the upstream flow or feed tanks B1, B2 for the product components, the mixing and homogenizing station MHS, and a buffer tank B3 for storing the finished product.

The denser liquid, usually a concentrate, is supplied to the apparatus at input $E_K$ to the tank B2. The lighter component, generally water, is supplied at the input $E_w$ to the tank B1. The finished product exits the system at the output $A_p$. The supply tank, mixing and homogenizing station and buffer tank are linked with program-controlled pneumatically switched valves V via a pipeline network. Monitoring sensors monitor the individual process steps of the process flow.

A displacement pump P1 for pumping concentrate and an impeller pump P2 for circulating the lighter product component in the supply tank B1 are used for transporting liquid within the apparatus.

The mixing of the product components and homogenizing of the mixture are effected in a propulsion jet nozzle e.g. I1 or I2 or I, also known as an injector, with two liquid inputs connected with the feed tanks B1, B2.

The pump P1 delivers a constant volumetric flow of concentrate to the injector from the tank B2 virtually regardless of the differential pressure. This serves as a propulsion jet and sucks the second component out of the tank B1. An orifice-containing member or element O is provided in the line between chamber $K_{B1}$ and the propulsion jet nozzles I1,I2,I3. The orifice in O assists in the metering or dosing the flow from B1. The flows of liquid are mixed together in the injector and are homogenized along a mixing length. The finished product then flows through a density measuring device DM and is guided into the buffer tank B3 for intermediate storage.

The purpose of the density measuring device is to monitor the preselected mixture ratio and to correct deviations from the reference value in cooperation with a regulator R and an adjustable throttle DR. This is effected by changing the pressure at the injector output via the throttle DR, which acts on the ratio of components in the combined liquid flows in the injector.

The proportioning accuracy of the injector system depends on a constant pressure difference between the injector inputs and the injector output during the mixing process, i.e. the pressure differences must be independent from other processes taking place in the apparatus and from the instantaneous operating state of the system, e.g. from the product removal or a stopping of the apparatus, etc.

The requirement for constant differential pressures at the proportioning system is met by the construction design of the two-component mixing apparatus shown in the drawing in that the gas spaces of the tanks B1, B2, B3 are connected with the environment together or alternately as shown in the drawing. Occurring pressure fluctuations can thus be compensated at any time.

Further, the liquid sucked out of the tank B1 maintains a constant feed level relative to the injector. It is not dependent on the amount of liquid flowing into the tank B1. This is achieved by an overflow system having a liquid space in the tank B1 which is divided in two with chambers $K_{B1}$, $K_{B2}$ and permanent circulation of the liquid by pump $P_2$.

The level of liquid in chamber $K_{B2}$ can fluctuate between a minimum and maximum below the overflow. The level is regulated by opening and closing the valve V1 which is controlled by a sensor S2. The pump P2 delivers more liquid from chamber $K_{B2}$ into chamber $K_{B1}$ than is removed from the latter during the mixing process. The surplus flows over an overflow edge back into chamber $K_{B2}$. The pump P2 runs continuously when the installation is operating without disruptions and ensures that the liquid in chamber $K_{B1}$ is always at the overflow edge.

The principle of level regulation by the overflow system is also realized in the buffer tank B3 by dividing the latter into chambers $K_{p1}$ and $K_{p2}$. This ensures that no fluctuations occur in the differential pressure at the output of the injector as a result of the operation of the apparatus. A circulating pump is dispensed with in this case, since the finished product is removed from $K_{p2}$ for further use.

The interconnected tanks and the constant level status of the liquids in the chambers $K_{B1}$ and $K_{B2}$ ensure constant system parameters at the proportioning system given stationary production and constant removal of product. However, for practical apparatus operation with inevitable disruptions in the production process, additional starting and stopping processes must be taken into account. To eliminate their influence on the proportioning accuracy to a great extent, the apparatus preferably also works by batch operation during continuous removal of product with respect to proportioning and mixing.

In so doing, every mixing process spans a certain period of time, generally 20 seconds, for example, and cannot be interrupted. It is initiated by opening the valve V2 during continuous operation of the pump P1 and is concluded by closing V2 after the mixing period expires. After a pause, e.g. approximately 10 seconds, the next batch can be started. However, this batch is released only when the level of the finished product in the buffer tank has sunk to the extent that its storage volume is sufficient to receive a full batch. In the mixing phase, the valve V3, a safety valve, is closed by spring force. During the intervals between batches, it opens due to the increasing line pressure. The pump P1 then circulates.

The advantage of batch operation consists in that the same quantities are always proportioned and mixed without being influenced by disruptions in the product process of a production line. A discontinuous product removal at the output $A_p$ has no effect on the proportioning accuracy.

In an apparatus of standard construction with a maximum production output of e.g.

$$L_{Pmax}=20\ m^3/h$$

and adjustable mixture ratios v (water/concentrate) between $$V_{min}=4.0$$

and $$V_{max}=8.0$$

a proportioning accuracy of $$\Delta v<|\pm 0.25|\%$$

can be achieved.

It is possible to expand the mixture ratio range by using a plurality of injectors I1, I2, and I3 as shown in FIG. 2. Automatically running CIP programs for cleaning and sterilizing the apparatus can also be realized, e.g. for the needs of the beverage industry. For this purpose, suitable tank cleaning heads T1, T2, etc. are arranged within the tanks and are connected, e.g. by lines, with the upstream or feed water $E_w$.

Figure 3:
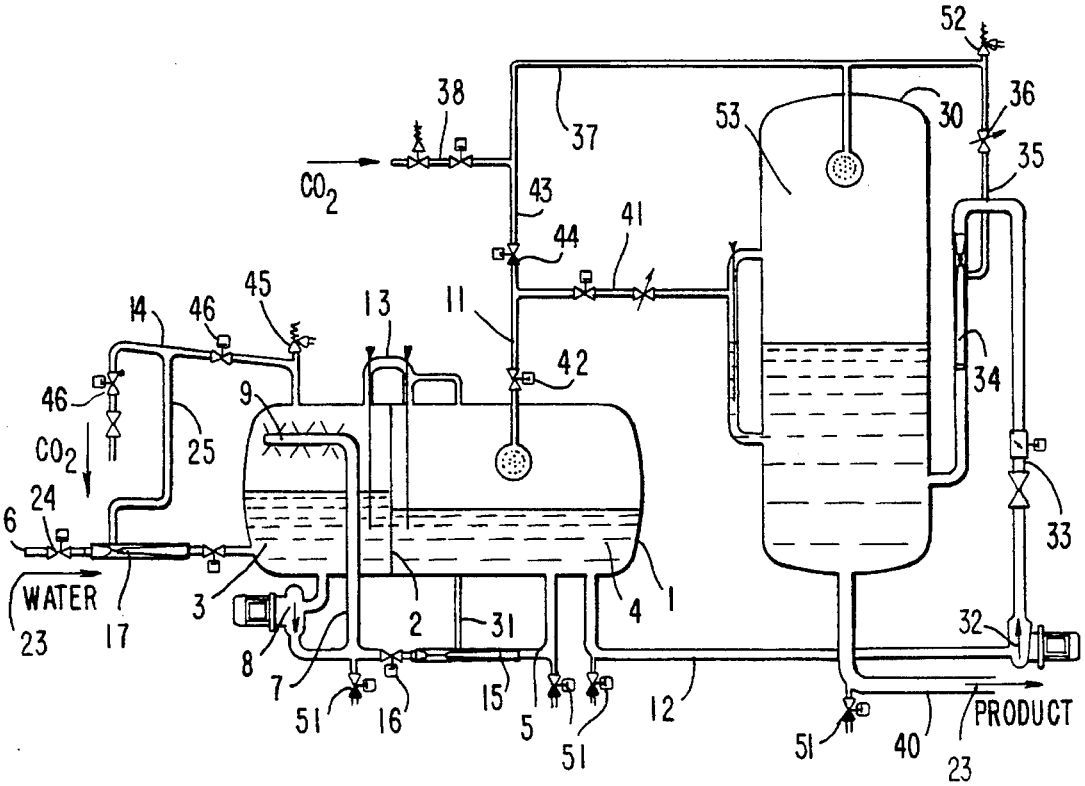
FIG. 3 shows an aerating and carbonizing apparatus for a liquid component with tanks according to the invention.

FIG. 3 shows a third embodiment of the apparatus according to the invention including a cylindrical horizontal tank 1. The interior of the tank 1 is divided into a first stage 3 and a second stage 4 by a vertically arranged dividing wall 2.

The liquid to be processed, e.g. water, is supplied to the tank 1 via feed line 6 in the lower region of the first stage 3.

An ejector 17 and cut-off valves 24 are arranged in the feed line 6. A vacuum line 25 of the ejector 17 is connected to the gas space of the first stage 3.

Further, a circulating line 7 is connected to the base of the first stage 3 and is provided with a pump 8 which feeds the liquid to a spray device 9 arranged in the gas space of the first stage 3.

A connection line 5 leads from the base of the first stage 3 to the base of the second stage 4. The connection line 5 has a cut-off valve 16 and an ejector 15 whose vacuum line 31 is connected to the gas spaces of the first and second stages 3, 4.

An outlet line 12 is connected to the base of the second stage 4 at the tank 1 and serves as an outlet for the processed liquid.

For after-treatment in a third stage 53, a second tank 30 is provided in which the processed liquid can be supplied by a pump 32 via a regulating valve 33 and an additional ejector 34. A vacuum line 35 of the ejector 34 has a regulating valve 36 and leads into the gas space of the second tank 30.

The outlet line 40, through which the finished product is conducted, is connected to the base of the second tank 30.

The ejectors 17, 15 and 34 suck gas through the liquid flow in a pressure region with reduced cross section via the vacuum lines 25, 31, 35 connected thereto. The sucked in gas is mixed with the liquid in a turbulent manner.

The gasification is effected contrary to the flow of the liquid so that the gas, in this case $CO_2$, is first supplied to the second tank 30. This is effected via feed line 37 with regulating and cut-off valve 38. A pressure-relief valve 52 is provided for safety reasons. An exchange of gas is possible inside the tank 30. The gas can be supplied to the second stage 4 of the tank 1 via feed line 11.

Regulating and cut-off valves 41, 42 are provided in feed line 11. A connection line 43 with cut-off valve 44 enables a direct feed of the gas to the second stage 4 in the tank 1. In a three-stage operation, the cut-off valve 44 is always closed.

The gas located in the gas space of the second stage 4 flows via connection line 13 into the gas space of the first stage 3. The concentration of supplied carbon dioxide decreases from the gas space of the second stage 4 to the gas space of the first stage 3 by partial exchange with gases dissolved in the liquid. Further, the carbon dioxide is diluted by the air emerging from the liquid to be processed, particularly in the first stage 3.

An aerating line 14 leads from the gas space of the first stage 3. A pressure-relief valve 45 and cut-off valves 46 are provided in the aerating line 14. The gas mixture is released to the environment via the aerating line 14.

For cleaning purposes or for converting production, the entire device can be emptied via a plurality of drain valves 51.

Figure 4:
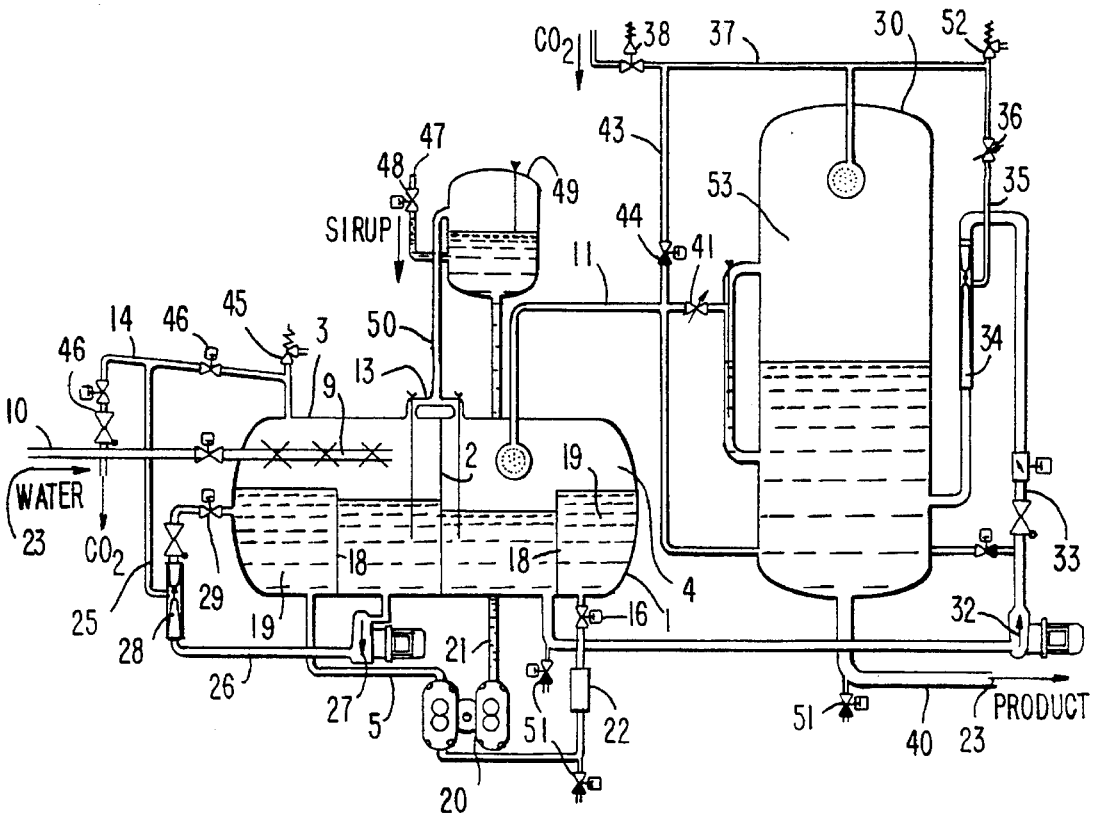
FIG. 4 shows a corresponding apparatus for the additional mixing of two liquid components.

FIG. 4 shows a final embodiment of the apparatus according to the invention which can mix a second liquid component in addition. A feed line 10 leads via cut-off valve 24 to the spray device 9 arranged in the gas space of the first stage 3. The liquid space of the first stage 3 and the second stage 4 are each divided into partial areas with an overflow weir 18. Partial areas 19 accordingly have a constant filling level so that the counter-pressure for the ejector and rotary piston pump 20 is permanently fixed.

The device has a circulating line 26 which is provided with a circulating pump 27, the ejector 28 and a cut-off valve 29. A vacuum line 25 of the ejector 28 is connected to the gas space of the first stage 3 of the tank 1.

The partial areas 19 of the first stage 3 and second stage 4 are connected via a connection line 5 with the rotary piston pump 20 and mixing pipe 22 arranged therein.

The cut-off valve 16 provided in the connection line 5 makes it possible to recirculate the liquid in the first stage 3 via circulating line 26 to start the device before the second stage 4 is switched on by opening the cut-off valve 16 after achieving a uniform and sufficient aeration.

The rotary piston pump 20 is constructed as a double pump and has a second feed line 21 for mixing in a second liquid component, in this case syrup. The second liquid component is supplied via line 47 with cut-off valve 48 to a supply tank 49 from which the mixing is effected via a feed line 21.

The twin-rotary piston pump 20 has a high proportioning accuracy by maintaining constant pressures between the suction side and pressure side of the pumps. A uniform mixture ratio is accordingly achieved. The mixing pipe 22 reinforces the mixing of the two liquid components. Further, a cut-off valve 16 is provided for closing the connection line 5. The outlet line 12 is arranged at the tank 1 as in FIG. 1. The arrangement and operation of the second tank 30 which is connected to the outlet line 12 corresponds to the tank 1 already described with reference to FIG. 1.

The feed line 11 guides the gas exiting from the third stage 53 of the second tank 30 to the gas space of the second stage 4 of the tank 1 in a counter-flow. The connection line 13 guides the gas/gas mixture further to the first stage 3 of the tank 1. A compensation line 50 which serves to compensate the pressure in the supply tank 49 of the second liquid component is connected to the connection line 13.

An aerating line 14 is arranged as described with reference to FIG. 1. However, the vacuum line 25 is not connected to the feed line 6, but rather to the ejector 28 arranged in the circulating line 26.

The exchange of gas and intensive aeration take place at the gas/liquid boundary surfaces in the three stages 3, 4, 53 in the tanks 1, 30. The gasification is preferably effected by the ejectors 15, 17 and 28, 34, respectively.

In this way, an installation is provided which has a high proportioning accuracy, in particular in batch operation and quasi-continuous finished product removal, without making use of costly capital-intensive proportioning pumps and the expensive measuring and regulating equipment used for the latter. In certain cases it is sufficient to use simple displacement pumps or even impeller pumps in connection with a sequential control. The installation is advantageously low-maintenance and operates in a reliable manner.

While the invention has been illustrated and described as embodied in an apparatus and process for homogeneous mixing of fluid components, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

LIST OF REFERENCE NUMBERS (FOR FIG. 1)

| | |
|---|---|
| B1 | feed tank |
| B2 | feed tank |
| B3 | feed tank |
| $E_k$ | input |
| $E_w$ | input |
| $K_{B1}$ | chamber |
| $K_{B2}$ | chamber |
| $K_{p1}$ | chamber |
| $K_{p2}$ | chamber |
| $L_A$ | compensation line |
| $L_R$ | cleaning line |
| P1 | displacement pump |
| P2 | impeller pump |
| P3 | displacement pump |
| MR | mixing pipe |
| S1 | filling level sensor |
| S2 | filling level sensor |
| T1 | tank cleaning head |
| T2 | tank cleaning head |
| V1 | feed valve |
| V2 | valve |
| V3 | valve |
| V4 | pressure-relief valve |
| V5 | feed valve |
| V6 | valve |
| V7 | valve |
| V8 | valve |
| V9 | valve |
| R1 | regulator |
| R2 | regulator |

LIST OF REFERENCE NUMBERS (FOR FIG. 2)

| | |
|---|---|
| B | tank |
| B1 | forerunning tank |
| B2 | forerunning tank |
| MHS | mixing and homogenizing station |
| B3 | buffer tank |
| E | input |
| $E_K$ | input concentrate |
| $E_W$ | input water |
| A | output |
| $A_p$ | output product |
| I | propulsion jet nozzle, injector |
| DM | density measuring device |
| R | regulator |
| DR | throttle |
| K | chamber |
| $K_{B1}$ | chamber |
| $K_{B2}$ | chamber |
| P | pump |
| P1 | ejector pump |
| P2 | pump |
| S | sensor |
| S2 | sensor |
| V | valve |
| V3 | safety valve |
| T | tank cleaning head |
| Z | feed line |

Indices:

| | |
|---|---|
| 1,2,3, etc. | counter numbers |
| K | concentrate |
| W | water |
| P | product |
| B | tank |

LIST OF REFERENCE NUMBERS (FOR FIGS. 3 and 4)

| | |
|---|---|
| 1 | tank |
| 2 | dividing wall |
| 3 | first stage |
| 4 | second stage |
| 5 | connection line |
| 6 | feed line |
| 7 | circulating line |
| 8 | pump |
| 9 | spray device |

-continued

| | |
|---|---|
| 10 | feed line |
| 11 | feed line |
| 12 | outlet line |
| 13 | connection line |
| 14 | aerating line |
| 15 | ejector |
| 16 | cut-off valve |
| 17 | ejector |
| 18 | overflow weir |
| 19 | partial area |
| 20 | rotary piston pump |
| 21 | second feed line |
| 22 | mixing pipe |
| 23 | flow direction |
| 24 | cut-off valve |
| 25 | vacuum line |
| 26 | circulating line |
| 27 | circulating pump |
| 28 | ejector |
| 29 | cut-off valve |
| 30 | second tank |
| 31 | vacuum line |
| 32 | pump |
| 33 | regulating valve |
| 34 | ejector |
| 35 | vacuum line |
| 36 | regulating valve |
| 37 | feed line |
| 38 | vacuum valve |
| 40 | outlet line |
| 41 | regulating and cut-off valve |
| 42 | cut-off valve |
| 43 | connection line |
| 44 | cut-off valve |
| 45 | vacuum valve |
| 46 | cut-off valve |
| 47 | line |
| 48 | cut-off valve |
| 49 | supply tank |
| 50 | compensation line |
| 51 | drain valve |
| 52 | pressure-relief valve |
| 53 | third stage |

I claim:

1. Process for mixing fluid components including a liquid component to form a mixed product having an actual mixture ratio as close as possible to a predetermined adjustable mixture ratio of said fluid components, said process comprising the steps of:

a) feeding said liquid component to a feed tank having an overflow weir dividing said feed tank into a first chamber and a second chamber;

b) circulating said liquid component from said second chamber to said first chamber to maintain a constant level of said liquid component in said second chamber and controlling a rate of said circulating of said liquid component by pumping means so that said liquid component in said second chamber overflows said overflow weir and so as to maintain a constant level of said liquid component in said first chamber at a fixed distance below that of said liquid component in said second chamber; and c) pumping said liquid component from said second chamber and pumping another of said fluid components to a mixing means at a controlled rate to form said mixed product and feeding said mixed product to a collection tank for collecting said mixed product so that said actual mixture ratio is within 0.25% of said predetermined mixture ratio.

2. Process as defined in claim 1, further comprising flowing said mixed product over another weir.

3. Process as defined in claim 1, further comprising mixing said fluid components in batches to form said mixed product and regulating a quantity of said liquid component in each of said batches.

4. Process as defined in claim 1, further comprising mixing said fluid components continuously to form said mixed product and regulating a rate at which said liquid component is supplied.

5. Process as defined in claim 1, further comprising dividing said collection tank into a first compartment and a second compartment by another overflow weir and feeding said mixed product into said second compartment of said collection tank so as to fill said second compartment so that said mixed product overflows said overflow weir and so that a level of said mixed product in said first compartment is below that of said mixed product in said second compartment.

6. Apparatus for homogeneous mixing of fluid components including a liquid component to form a mixed product, said apparatus comprising a feed tank (B1) for said liquid component, means for maintaining a predetermined constant level of said liquid component in at least one part of said feed tank (B1), said means for maintaining the predetermined constant level including an overflow weir in said feed tank (B1); a plurality of feed lines for said fluid components, at least one of said feed lines supplying said feed tank (B1) with said liquid component; at least one outlet line ($A_p$) for said mixed product and a mixing pipe (MR) connected between said feed tank (B1) and said at least one outlet line ($A_p$), said mixing pipe including means for mixing said fluid components to form said mixed product.

7. Apparatus as defined in claim 6, further comprising a collecting tank (B3) connected between said said mixing pipe (MR) and said at least one outlet line ($A_p$), and wherein said collecting tank (B3) contains an overflow weir to maintain a uniform counter-pressure at said mixing pipe (MR).

8. Apparatus as defined in claim 7, further comprising another feed tank (B2) for another of said fluid components and a pump (P1) including a regulated drive motor, said pump (P1) being connected between said other feed tank (B2) and said collecting tank (B3) to feed said other fluid component from said other feed tank (B2) and another pump (P3) including a regulated drive motor and connected between said feed tank (B1) and said collecting tank (B3), said mixed product being supplied to said collecting tank (B3) at a regulated rate by said pump (P1) and said other pump (P3).

9. Apparatus as defined in claim 8, wherein said feed feed tanks (B1, B2) and said collecting tank (B3) have pressure compensating openings connected with each other via pressure compensating lines ($L_A$).

10. Apparatus as defined in claim 8, wherein said feed tank (B1) is divided into a first chamber and a second chamber by said overflow weir, and further comprising an additional pump (P2) for circulating said liquid component from said second chamber to said first chamber so as to maintain a constant level of said liquid component in said first chamber below a level of said liquid in said second chamber and to overflow said overflow weir with said liquid component in said second chamber.

11. Apparatus as defined in claim 10, further comprising means for measuring an actual mixture ratio of said fluid components in said mixed product to determine said actual mixture ratio and regulating means for controlling at least one of said pumps based on said actual mixture ratio, said regulating means being connected to said means for measuring to receive said actual mixture ratio and to said at least one pump and to control said at least one pump to change said actual mixture ratio so that said actual mixture ratio is closer to said predetermined mixture ratio.

12. Apparatus as defined in claim 8, wherein said pump (P1) is an ejector pump having a constant volumetric flow.

13. Apparatus as defined in claim 12, wherein said ejector pump is a displacement pump.

14. Apparatus as defined in claim 7, further comprising means for adjusting a height of at least one of said overflow weirs.

15. Apparatus as defined in claim 14, further comprising means for measuring an actual mixture ratio of said fluid components in said mixed product to determine said actual mixture ratio and regulating means for controlling at least one of said overflow weirs based on said actual mixture ratio, said regulating means being connected to said means for measuring said actual mixture ratio so as to receive said actual mixture ratio and to said means for adjusting said height of said at least one overflow weir to control said height.

16. Apparatus as defined in claim 6, further comprising additional mixing and proportioning means connected to said at least one outlet line ($A_p$).

17. Apparatus as defined in claim 6, further comprising a filling level sensor (S1) attached to said feed tank (B1) for said liquid component, and valve means in said feed line connected to said feed tank (B1) for said liquid component and actuating means connecting said filling level sensor with said valve means to actuate said valve means when a level of said liquid component in said feed tank (B1) falls below a predetermined level.

18. Apparatus for homogeneous mixing of fluid components including a liquid component to form a mixed product, said apparatus comprising a feed tank (B1) for said liquid component, means for maintaining a predetermined constant level of said liquid component in at least one part of said feed tank (B1), said means for maintaining the predetermined constant level including an overflow weir in said feed tank (B1); a plurality of feed lines for said fluid components, at least one of said feed lines supplying said feed tank (B1) with said liquid component; at least one outlet line ($A_p$) for said mixed product; at least one injector (I1,I2,I3) for mixing said fluid components to form said mixed product and means for controlling an actual mixture ratio of said fluid components, said at least one injector having injector inlet pipes and an injector outlet pipe having adjustable differential pressures.

19. Apparatus as defined in claim 18, wherein said means for controlling said actual mixture ratio of said fluid components includes adjustable throttle means (DR) for changing an outlet pressure at said at least one injector and a density measuring device (DM) for measuring a density of said mixed product connected to said adjustable throttle means (DR) and located downstream of said adjustable throttle means, said adjustable throttle means (DR) being connected between said at least one injector (I1,I2,I3) and said density measuring device (DM), and regulating means (R) for controlling said adjustable throttle means according to said density measuring device, said regulating means being connected between said adjustable throttle means (DR) and said density measuring device (DM).

20. Apparatus as defined in claim 18, wherein said at least one injector (I1,I2,I3) has at least one injector propulsion line and means for supplying a constant propulsion pressure to said at least one injector on said at least one injector propulsion line.

21. Apparatus as defined in claim 18, further comprising means for throttling a flow of said mixed product, means for measuring said mixture ratio connected with said means for throttling said flow of said mixed product so as to maintain a differential pressure on said injector outlet pipe substantially constant.

22. Apparatus as defined in claim 18, wherein said at least one injector comprises two injector devices and said two injector devices are connected in parallel to each other.

23. Apparatus as defined in claim 18, further comprising at least one pre-proportioning tank connected to said at least one injector for said fluid components to be mixed with said at least one injector.

24. Apparatus as defined in claim 18, further comprising a at least one receiving tank for receiving a partial amount of said mixed product connected to said at least one injector.

25. Apparatus as defined in claim 18, further comprising an orifice-containing member (O) provided with an orifice for metering fluid flow, said orifice-containing member (O) being located between said feed tank (B1) and said at least one injector (I1,I2,I3) to meter said liquid component.

26. Apparatus for homogeneous mixing of fluid components including a liquid component to form a mixed product, said apparatus comprising a feed tank (B1) for said liquid component having an overflow weir, said overflow weir dividing said feed tank (B1) into a first chamber and a second chamber; another feed tank (B2) for another of said fluid components; mixing means for said liquid component and said other fluid component; pump means (P3) having a regulated drive motor connected to said second chamber of said feed tank (B1) to feed said liquid component to said mixing means; another pump means (P1) connected to said other feed tank (B2) to feed said other fluid component to said mixing means at a controlled rate; a collecting tank (B3) having an overflow weir to maintain a uniform counter-pressure at said mixing means, said collecting tank being connected to said mixing means to receive a mixed product formed from said liquid component and said other fluid component from said mixing means; and additional pump means (P2) for circulating said liquid component from said second chamber of said feed tank (B1) to said first chamber of said feed tank (B1) to maintain a level of said liquid component in said first chamber at a constant level below a level of said liquid component in said second chamber, said liquid component overflowing said overflow weir in said feed tank (B1) during operation, to provide constant pressure difference across said pump means (P3) feeding said liquid component to said mixing means.

* * * * *